United States Patent [19]

Dino et al.

[11] 4,396,828

[45] Aug. 2, 1983

[54] PILL COUNTER

[75] Inventors: William C. Dino; Stephen L. Johnson, both of Worcester, Mass.

[73] Assignee: Programs & Analysis, Inc., Burlington, Mass.

[21] Appl. No.: 190,930

[22] Filed: Sep. 26, 1980

[51] Int. Cl.[3] ..... B65B 57/20

[52] U.S. Cl. ..... 377/6; 221/7; 235/92 PK; 235/98 C; 250/224; 377/53

[58] Field of Search ..... 235/92 PC, 92 PK, 92 V, 235/98 C; 250/224, 222 R, 222 PC; 221/7, 8

[56] References Cited

U.S. PATENT DOCUMENTS

| | | | |
|---|---|---|---|
| 3,207,909 | 9/1965 | Lakso | 235/98 C |
| 3,290,488 | 12/1966 | Sewell | 235/92 PC |
| 3,760,166 | 9/1973 | Adams | 235/92 PK |
| 3,789,194 | 1/1974 | Kirby | 235/92 V |
| 3,837,139 | 9/1974 | Roseberg | 221/7 |
| 3,900,718 | 8/1975 | Seward | 235/98 C |
| 3,928,753 | 12/1975 | Kivett | 235/92 PK |
| 4,013,192 | 3/1977 | Pillon | 221/7 |
| 4,018,358 | 4/1977 | Johnson | 221/7 |
| 4,111,332 | 9/1978 | Hurst | 221/7 |

*Primary Examiner*—Howard Britton
*Attorney, Agent, or Firm*—Blodgett & Blodgett

[57] ABSTRACT

Counter for pills, including an inclined tray and a photoelectric counter serving a digital readout.

17 Claims, 12 Drawing Figures

FIG. 1
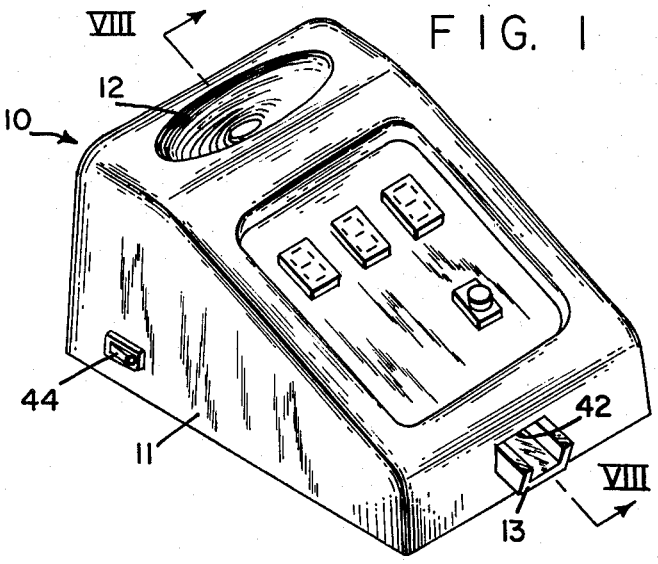
FIG. 2
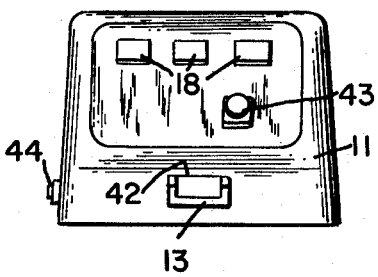
FIG. 3
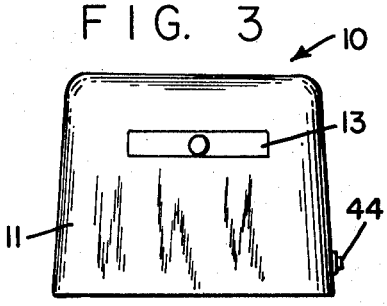
FIG. 4
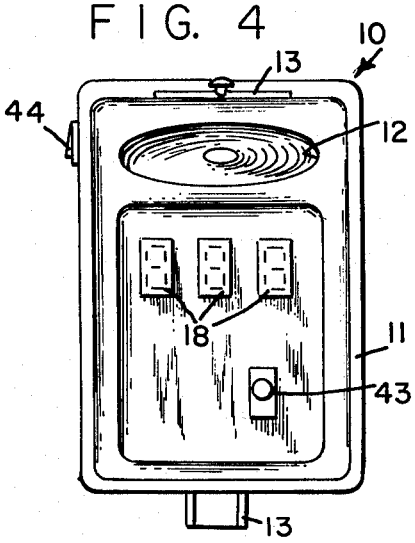
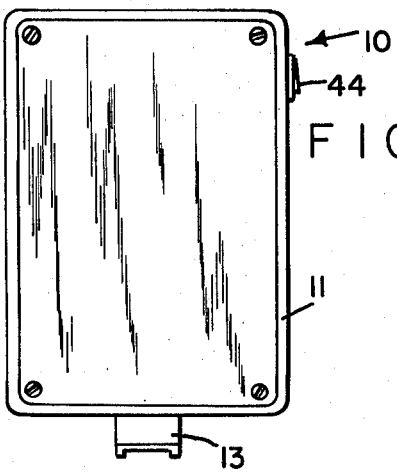
FIG. 5
FIG. 6
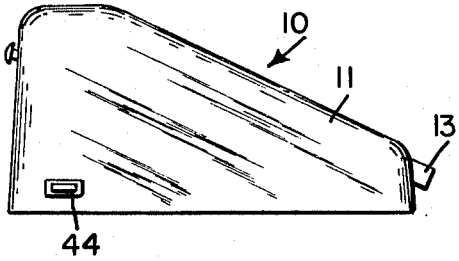
FIG. 7
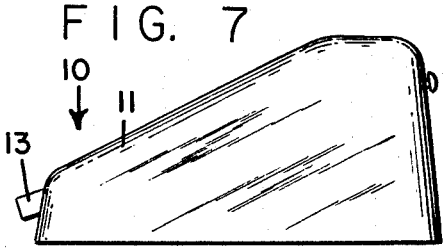

PILL COUNTER

BACKGROUND OF THE INVENTION

In the pharmaceutical industry, one of the most perplexing problems is that of counting pills. Usually this activity is done manually and this results in a slowing down of the filling of prescriptions. Attempts have been made in the past to provide apparatus for automatically counting pills, but they have in general been complex, inaccurate, and subject to frequent breakdown. These and other difficulties experienced with the prior art devices have been obviated in a novel manner by the present invention.

It is, therefore, an outstanding object of the invention to provide a pill counter having a high degree of accuracy.

Another object of this invention is the provision of a pill counter which is portable and only requires connection to electrical outlet.

A further object of the present invention is the provision of a pill counter which is simple in construction, which is inexpensive to manufacture, and which is capable of a long life of useful service.

It is another object of the instant invention to provide a counter for medicinal pills in which a tray along which the pills travel in independent of electrical apparatus and which may be removed and cleaned without difficulty.

A still further object of the invention is the provision of a pill counter that includes a photoelectric device and an inclined tray having dividing walls which cause the pills to pass a reading area seriatim.

A still further object of the invention is the provision of a pill counter, including a photoelectric counter with circuitry to guarantee that false readings do not take place.

It is a further object of the invention to provide a pill counter, including an inclined tray having dividing walls defining passages, wherein the walls are arranged that two pills side-by-side cannot block the entrance to a passage.

With these and other objects in view, as will be apparent to those skilled in the art, the invention resides in the combination of parts set forth in the specification and covered by the claims appended hereto.

SUMMARY OF THE INVENTION

In general, the present invention consists of a pill counter having a housing with an entrance chute and an elongated tray mounted in the housing with one end underlying the chute and the other end located at a lower position. A photoelectric counter is mounted in the housing to count the pills as they pass from one end to the other of the tray and a digital readout is mounted on the housing to display the count of pills.

More specifically, the tray is formed of transparent material and the counter consists of a radiation-emitting device under the tray and a photo-sensitive device above the tray. The photo-sensitive device is connected to the readout by a pulse counter and a decoder/driver, while it is also connected to the pulse counter through a pulse-treating circuit that removes pulse flutter and shapes the pulse. A row of longitudinal walls of limited length are located between sidewalls of the tray. The divider walls are equally spaced between the sidewalls and each divider wall has its upstream edge lying at an acute angle to the upper surface of the bottom wall of the tray. The divider walls are alternately smaller and longer in length to prevent two pills from resting between the upper ends of two adjacent walls.

BRIEF DESCRIPTION OF THE DRAWINGS

The character of the invention, however, may be best understood by references to one of its structural forms, as illustrated by the accompanying drawings, in which:

FIG. 1 is a perspective view of a pill counter embodying the principles of the present invention, FIGS. 2–7 are front elevation, rear elevation, top plan, bottom plan, left side elevational, and right side elevational views of the device, respectively.

DESCRIPTION OF THE PREFERRED EMBODIMENT

Figure 8:
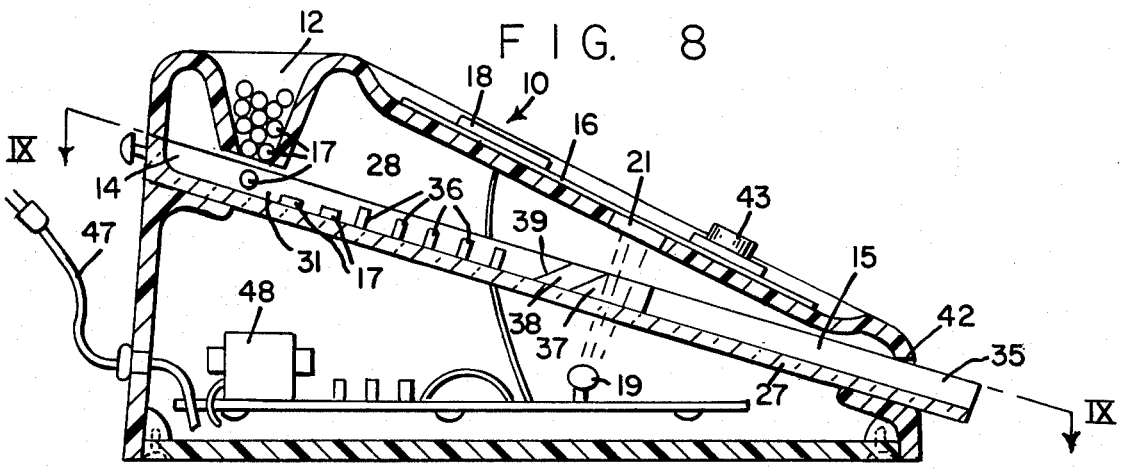
FIG. 8 is a vertical sectional view of the counter taken on the line VIII—VIII of FIG. 1.

Referring first to FIGS. 1–7, which best show the general features of the invention, it can be seen that the pill counter, indicated generally by the reference numeral 10, is provided with a housing 11, having an entrance chute 12 at its upper end. An inclined face is provided with a digital readout 18, while an elongated tray 13 is mounted in the housing with one end underlying the chute 12 and the other end located at a lower position and extending through an aperture 42. Located on the housing is a reset switch 43 and a power switch 44.

Figure 9:
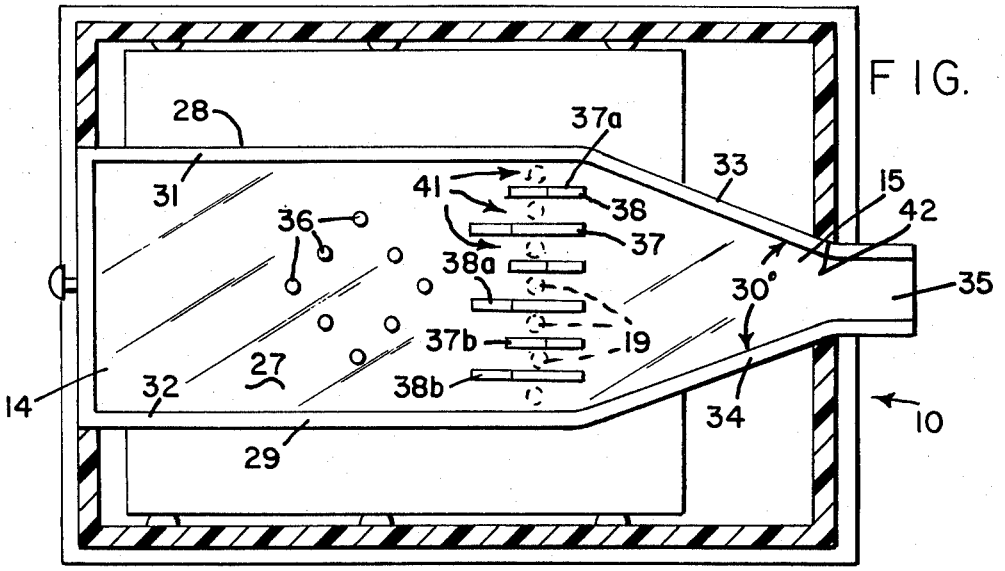
FIG. 9 is a generally horizontal sectional view of the counter taken on the line IX—IX of FIG. 8.

Referring next to FIGS. 8 and 9, which best show the details of construction, it can be seen that the tray 13 is mounted in the housing 11 with one end 14 underlying the chute 12 and the other end 15 located at a lower position. A photo-electric counter 16 is mounted in the housing to count the pills 17 as they pass from the upper end 14 to the lower end 15 of the tray. The digital readout 18 is mounted on the housing, preferably on top of the printed circuit which includes the photo-electric counter 16 to display the count of pills.

The tray 13 is formed of a transparent material, such as a methyl-methocrylate plastic. The counter 16 consists of a radiation-emitting device 19, such as a lamp, located under the tray and of a photo-sensitive device 21 located on the housing above the tray and forming part of the printed circuit.

The tray 13 is formed with a flat bottom wall 27 having symmetrical sidewalls 28 and 29. The upper portions 31 and 32 of the sidewalls 28 and 29, respectively, are straight, spaced, and parallel. The said upper portions of the sidewalls merge at their lower ends with inwardly-inclined lower portions 33 and 34 of the sidewalls that lead to a narrow discharge portion 35. A plurality of pegs or pins 36 are mounted in the bottom wall 27 adjacent the upper end, the pins being located in a diamond-shaped pattern. A row of longitudinal divider walls 37, 38, **37*a*, 38*a*, 37*b*, 38*b* are located between the lower ends of the upper portions 31 and 32 of the sidewalls. The divided walls are equally spaced between the sidewalls and each divider wall has its upstream edge lying at an acute angle to the upper surface of the bottom wall, as indicated by the upstream edge 39 shown in FIG. 8. There are six divider walls of which the walls 37, 37***a* and 37*b* are short, while the walls 38, 38*a* and 38*b* are long. This arrangement serves to prevent two pills from resting between the upper ends of two adjacent walls; the staggered relationship combine with the inclined leading edge assists in this function. Since there are six divider walls between the sidewalls, seven flow passages 41 are thus defined. The lower portions 33 and 34 of the sidewalls are inclined at an angle of approximately 30° to one another. A series of seven of the radiation-emitting devices 19 are located under the tray with one in each passage. The tray 13 is removably mounted in the housing 11 and has a discharge trough 35 at its lower end that extends through an aperture 42 in the housing to discharge pills that have been counted.

Figure 10:
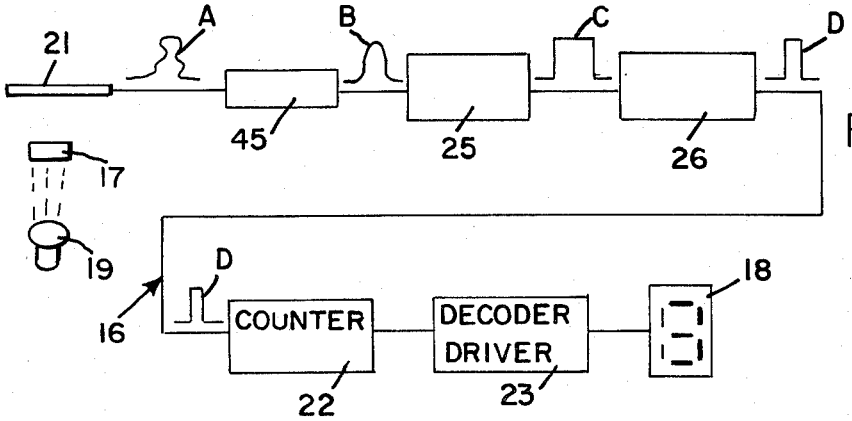
FIG. 10 is a schematic view of the electrical apparatus included in the counter.
Figure 11:
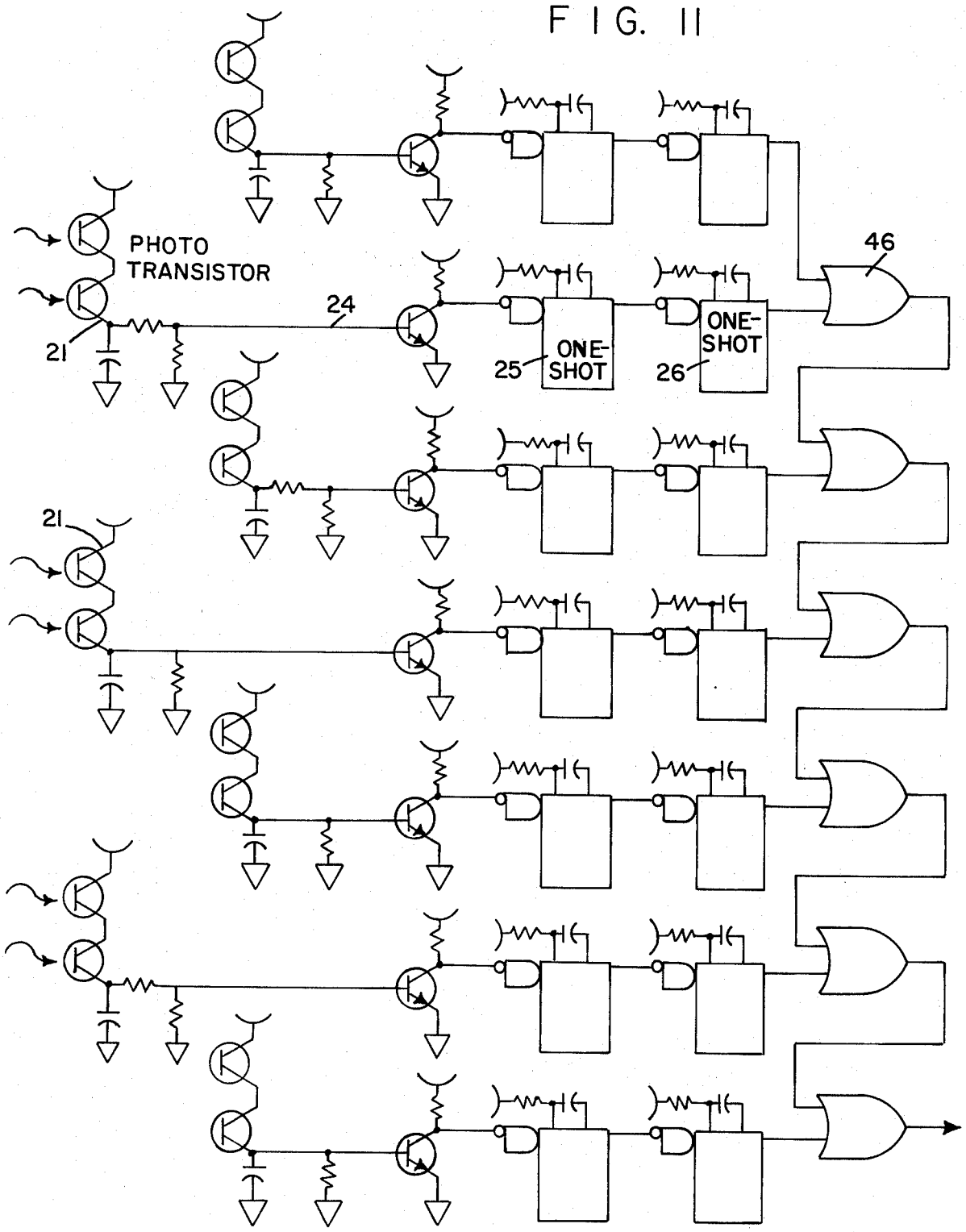
FIGS. 11 and 12 show the electronic circuitry used in the counter.
Figure 12:
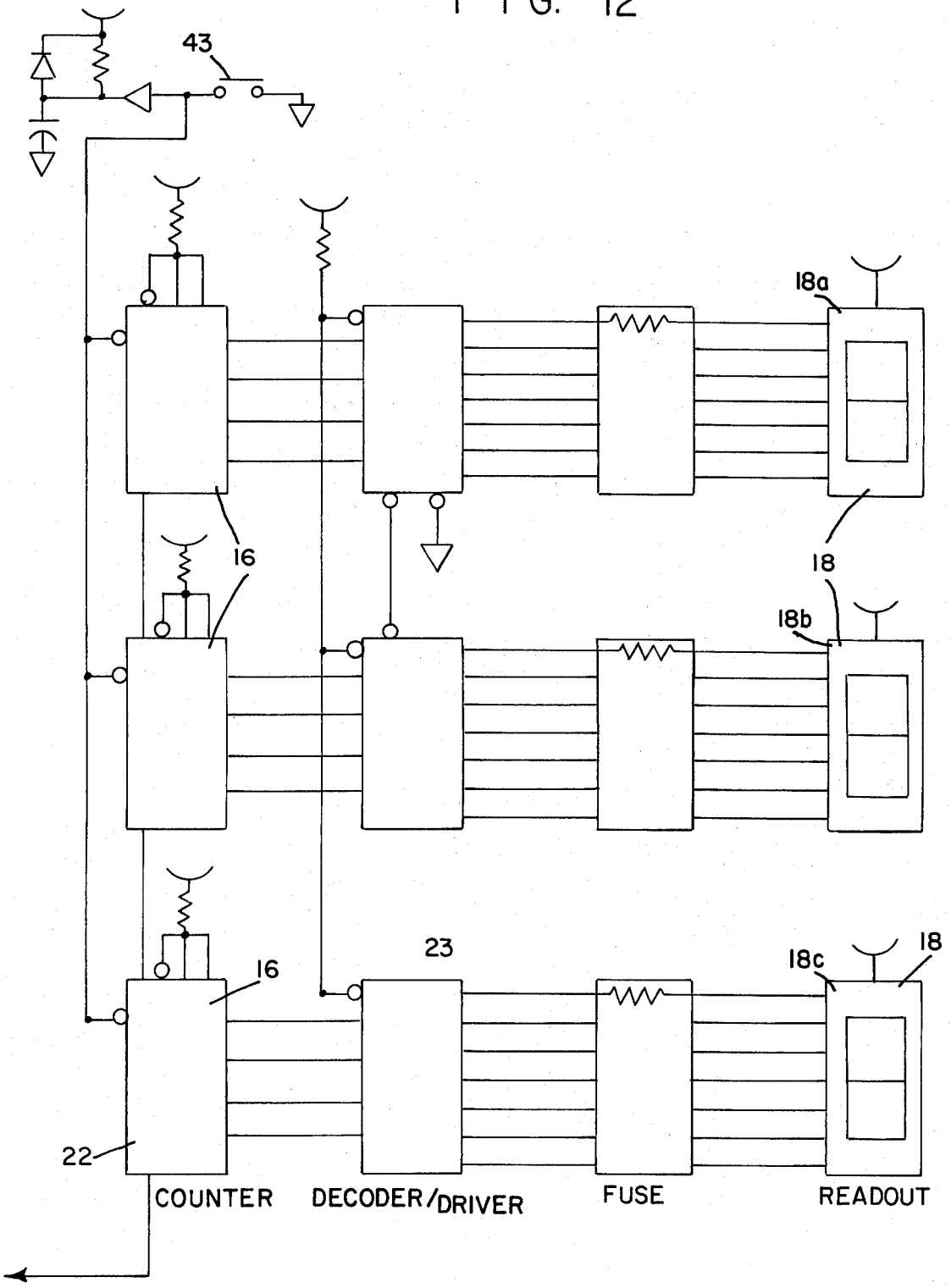

Referring to FIGS. 10, 11 and 12, as has been stated, the radiation-emitting device 19 is a lamp, while the photosensitive device 21 is a photo-transistor. In a commercial embodiment of the invention, the device 21 is the Fairchild transistor known as FPT 110. The readout 18 consists of three light-emitting diode-type alphanumeric readout devices which in the commercial embodiment is a MAN-6660. The device 18*c* shows the least significant digit. There are a series of seven lamps and photo-transistors associated with the device, but only one photo-transistor and its associated circuitry will be described. The transistor 21 is connected to the readout 18 by a digital counter 22 and a decoder/driver 23. The transistor 21 is connected to the pulse counter 22 through a pulse-treating circuit 24 which serves to remove pulse flutter and shapes the pulse. The circuit 24 includes a long-time one-shot 25 for changing the pulse to a wide square wave and a short-time one-shot 26 for changing the pulse to a narrow square wave. The circuit 24 also includes an amplifying transistor 45 leading into the one-shot 25 and an OR gate 46 leading into the three counters 22 connected to the three digital readouts 18*a*, 18*b*, and 18*c*. A reset switch 43 is provided to run the counters 22 back down to zero when desired.

In a commercial version of the invention, the amplifying transistor 45 is a 2N222 which serves to double the voltage in the original pulse generated by the photo-transistor 21 and also to smooth out the envelope shape of the pulse. The first one-shot 25 is a Type 74123 with a time of 10 mileiseconds, while the second one-shot 26 is also a Type 74132, but with a time of 1 micro-second. The OR gate 46 is a Type 7432, while the counter 22 is a type 74160 and the decoder/driver 23 is a Type 7447.

The operation of the invention and its advantages will now be readily understood in view of the above description. The counter is mounted on a shelf where it may be used for counting pills. A power cord 47 is inserted into an electrical convenience outlet, thus supplying power to a power circuit 48 mounted within the housing 11. The power switch 44 is actuated and this lights up the radiation-emitting device 19. The reset switch 43 is pressed and this empties the counters 22 and causes the readout 18 to read 000. The pills are inserted into the entrance chute 12 and they fall downwardly onto the upper surface of the bottom wall 27 of the tray 13. The pills 17 roll or otherwise pass downwardly until they strike the pins 36. This has the effect of distributing the pills laterally and preventing any segregated flow down the center of the tray. The pills then enter the passages 41, pass down the passages into the reduced section defined by the walls 33 and 34, and then pass outwardly of the housing through the discharge portion 35 of the tray into a waiting receptacle. As each pill passes through its passage 41, it passes between a lamp 19 and its corresponding photo-transistor 21. Referring particularly to FIG. 17, the pill 17 is passing between the lamp 19 and the photo-transistor 21 generates a pulse A. It may have a very irregular envelope, because of various reflections and the like in the apparatus. The pulse then enters the amplifying transistor 45 and is enlarged in height (voltage) and this also serves to improve the envelope and make the pulse more regular, as shown by the pulse B. The leading edge of the pulse B strikes the one-shot 25 and actuates it; this causes it to admit voltage for the long time for which it is set, namely 10 milei-seconds. This produces a square, wide wave C. When the pulse C strikes the one-shot which passes a voltage for a relatively short time, namely micro-second and this produces a narrow square wave D, which pulse operates the counter 22 effectively and causes it to act through the decoder/driver 23 to set the readout 18 the next higher digit.

It can be seen, then, that the present invention permits the very accurate counting of the pills, since the arrangement of the pins 36 and the divider walls 37 and 38 obviate the possibility of two pills passing down the channels 41 at exactly the same time. Statistically, it can be shown that the probability of two pills operating their phototransistors 21 at exactly the same time (or at a slightly removed time) is very slim. If two pills do come down closely together, the pulse that is generated first will serve to increase the count in the readout 18. The other pill will not be counted, so that the customer will receive one extra pill in this infrequent event. The passage of pills down the tray may cause a discoloration of the transparency of the tray and also of a certain degree of contamination of later counted pills by powder from a preceeding pill. For this reason, it can be seen that the tray 13 is entirely electrically isolated from the reading equipment and is loosely held within the housing, so that it can be easily removed and washed without any difficulty. Jamming of the pills is prevented by, first of all, providing an inclined edge 39 at the leading edge of the dividing walls 37 and long walls 38. This arrangement prevents two pills arriving side-by-side and jamming (or being located side-by-side in a fixed position) at the leading edge of the walls. The shaping of the pulse emanating from the photo-transistor 21 assures that accurate counting take place by shaping and narrowing the pulse, thus removing any pulse flutter or double counting.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Pill counter, comprising:

(a) a housing having an entrance chute, (b) an elongated easily removable tray mounted in the housing with one end underlying the chute and the other end located at a lower position, (c) a photoelectric counter mounted in the housing to count pills as they pass from one end to the other of the tray, and (d) a digital readout mounted on the housing to display the count of pills.

2. Pill counter as recited in claim 1, wherein the tray is removably mounted in the housing and has a discharge trough at its other lower end that extends through an aperture in the housing to discharge pills that have been counted.

3. Pill counter as recited in claim 1, wherein the tray is provided with a non-moving deflecting means fixedly mounted on the tray between the one end and the said other end and adapted to laterally randomly deflect the pills as they pass from the said one end to the said other end.

4. Pill counter as recited in claim 1, wherein a plurality of pins are mounted on a bottom wall of the tray adjacent the said one upper end, the pins being located in a diamond-pattern.

5. Pill counter as recited in claim 1, wherein the tray is formed of transparent material, and wherein the counter consists of a radiation-emitting device under the tray and a photosensitive device above the tray.

6. Pill counter as recited in claim 5, wherein the radiation-emitting device is a lamp, wherein the photosensitive device is a phototransistor, and wherein the readout is of the light-emitting diode type.

7. Pill counter as recited in claim 6, wherein the phototransistor is connected to the readout by a pulse counter and a decoder/driver.

8. Pill counter as recited in claim 7, wherein the phototransistor is connected to the pulse counter through a pulse-treating circuit that removes pulse flutter and shapes the pulse.

9. Pill counter as recited in claim 8, wherein the circuit includes a long-time one-shot for changing the pulse to a wide square wave and a short-time one-shot for changing the said wide square wave to a narrow square wave.

10. Pill counter as recited in claim 1, wherein the tray is formed with a flat bottom wall and with symmetrical side walls, the upper portion of the side walls in the said one end being straight, spaced and parallel, the upper portions of the side walls merging at their lower ends with inwardly-inclined lower portions leading to a discharge portion.

11. Pill counter as recited in claim 10, wherein a plurality of pins are mounted in the bottom wall adjacent the upper end, the pins being located in a diamond-pattern.

12. Pill counter as recited in claim 11, wherein a row of longitudinal divider walls of limited length are located between the lower ends of the upper portions of the walls, the divider walls being equally spaced between the side walls, each divider wall having its upstream edge lying at an acute angle to the upper surface of the bottom wall.

13. Pill counter as recited in claim 12, wherein the divider walls are alternately smaller and longer in length to prevent two pills from jamming between the upper edges of two adjacent walls.

14. Pill counter as recited in claim 13, wherein there are six divider walls between the side walls, thus defining seven flow passages, and wherein the lower portions of the side walls are inclined at an angle of approximately 30° to one another.

15. Pill counter as recited in claim 14, wherein the photoelectric counter is located in the passages between the side walls and divider walls.

16. Pill counter, comprising:

(a) a housing having an entrance chute, (b) an elongated tray mounted in the housing with one end underlying the chute and the other end located at a lower position, the tray being formed with a flat bottom wall and with symmetrical side walls, the upper portion of the side walls in the said one end being straight, spaced and parallel, the upper portions of the side walls merging at their lower ends with inwardly-inclined lower portions leading to a discharge portion, wherein a plurality of pins are mounted in the bottom wall adjacent the upper end, the pins being located in a diamond-pattern, (c) a photoelectric counter mounted in the housing to count pills as they pass from one end to the other of the tray, and (d) a digital readout mounted on the housing to display the count of pills.

17. Pill counter, comprising:

(a) a housing having an entrance chute, (b) an elongated tray mounted in the housing with one end underlying the chute and the other end located at a lower position, (c) a photoelectric counting circuit mounted in the housing to count pills as they pass from one end to the other of the tray, the circuit including a long-time one-shot for changing the pulse to a wide square wave and a short-time one-shot for changing the wide square wave pulse to a narrow square wave, and (d) a readout operated by the counter to display the count of pills.

* * * * *